United States Patent [19]

Lindahl

[11] 4,444,621

[45] Apr. 24, 1984

[54] PROCESS AND APPARATUS FOR THE DERESINATION AND BRIGHTNESS IMPROVEMENT OF CELLULOSE PULP

[75] Inventor: Jonas A. I. Lindahl, Domsjo, Sweden

[73] Assignee: Mo och Domsjo Aktiebolag, Ornskoldsvik, Sweden

[21] Appl. No.: 326,866

[22] Filed: Dec. 3, 1981

Related U.S. Application Data

[63] Continuation-in-part of Ser. No. 208,909, Nov. 21, 1980, which is a continuation-in-part of Ser. No. 186,037, Sep. 11, 1980, abandoned.

[51] Int. Cl.[3] ..... D21B 1/04

[52] U.S. Cl. ..... 162/26; 162/28; 162/56; 162/72; 162/78; 162/87; 162/90

[58] Field of Search ..... 162/18, 19, 24, 25, 162/56, 28, 26, 55, 65, 71, 78, 89, 90, 87, 82

[56] References Cited

U.S. PATENT DOCUMENTS 4,294,653 10/1981 Lindahl et al. ..... 162/78

FOREIGN PATENT DOCUMENTS 902306 6/1972 Canada ..... 162/24

*Primary Examiner*—Peter Chin

[57] ABSTRACT

A process and apparatus are provided for the deresination and brightness improvement of cellulose pulp, by adjusting the pulp concentration to within the range from about 15 to about 35%; adding sufficient alkali to the pulp to bring the amount of alkali, calculated as NaOH, within the range from about 0.5 to about 17 g/kg of water accompanying the pulp; adding sufficient oxidizing bleaching agent to the pulp to bring the amount of oxidizing bleaching agent to within the range from about 0.2 to about 22 g/kg of water; subjecting the pulp to a mild, mechanical working in the bite of twin interdigitated rotating screws at an energy input of from 8 to 100 kWh per ton of pulp; removing and reacting the pulp with the added alkali and bleaching agent for from about 0.1 to about 5 hours; and then washing out dissolved resin from the pulp.

20 Claims, 1 Drawing Figure

Figure 1:
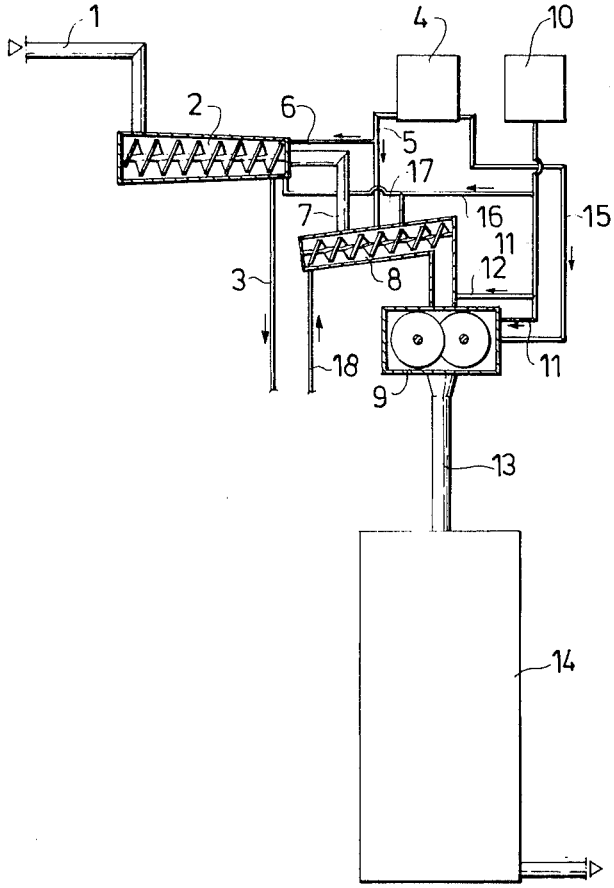

PROCESS AND APPARATUS FOR THE DERESINATION AND BRIGHTNESS IMPROVEMENT OF CELLULOSE PULP

This application is a continuation-in-part of Ser. No. 208,909, filed Nov. 21, 1980, which in turn is a continuation-in-part of Ser. No. 186,037 filed Sept. 11, 1980 now abandoned.

Rydholm, *Pulping Processes* Interscience Publishers, 1965, page 1024, characterizes resin and pitch as organo-soluble matter which occur in the pulp and as a deposit on the pulp and paper-making machinery, and which originate from the extractives of the wood, with much that is unknown of its chemical nature, since it represents a mixture of incompletely investigated and fairly reactive substances of the wood, which have undergone a sequence of rather severe chemical treatments.

Rydholm states that resin is an undesirable component of the pulp. While part of the resin in dissolving pulps may have a beneficial surface activity in the viscose process, excessive amounts of resin affect the processing and product properties of the dissolving pulps adversely. The resin content of dissolving pulps should, therefore, be kept within fairly rigid limits, usually 0.15 to 0.30%. In the processing of paper pulps, resin deposits on the paper machine, as well as foaming, are experienced from resinous pulps, and also resin specks in the paper. Clogging of filters and screens, deposits on moving metal parts, as well as on bleach-hollander linings, causing sudden contamination of the pulp, are among the resin troubles encountered in the pulp mill. Another disadvantage of the pulp resin is the phenomenon of self-sizing, which occurs on the storage of paper products through the redistribution of the resin over the entire fiber surface. This impairs the absorptive properties of tissue or the wettability of corrugating medium paper by silicate glue. The main weapons used to fight resin troubles are:

(1) Seasoning of the wood.
(2) Efficient washing of the pulp after cooking.
(3) Fiber fractionation.
(4) Alkaline extraction.
(5) Additions of surface-active agents and sequestering agents.

When pulp is prepared by the sulfite process, the wood is always stored a considerable time, usually up to one year, before digestion, because during storage, so-called seasoning, a change in the physical character of the resin occurs, reducing the amount of resin in the wood, and also changing the resin so that it is more easily dissolved during the pulping.

The storage of the wood can be carried out in different ways. For example, the wood in the form of logs can first be stored in water, as in floating and towing, after which the logs are stored on land in a wood yard. After storage of about one year, the logs are taken into the pulp mill for cutting into chips and pulped.

Another method is to reduce the logs to chips when they arrive at the pulp mill, and then store the chips in a pile. Treating the wood in this way can decrease the storage time to about three months.

Regardless of the method of storage, the treatment always adds to the cost, and a certain loss of wood is obtained, while at the same time capital is tied up in the stored logs or chips. More and more, it is necessary because of a short supply of wood to cut short the storage time, or even eliminate it altogether, which complicates the resin problem.

In spite of the storage, the wood still contains considerable amounts of resin, though in a slightly changed form, compared to the resin in the fresh wood. The larger part of the remaining resin content is removed in different stages during the pulp preparation procedure. To remove all resin from the pulp is difficult and, above all, expensive. Finished pulp therefore almost without exception contains a certain amount of resin. During the digestion of the wood, part of the resin is dissolved, and removed during washing and screening the pulp.

The final adjustment of the resin content of the pulp is carried out during the bleaching stage, primarily by dissolution and removal in the alkaline stage of the bleaching sequence. It is, however, possible and not unusual to carry out the final resin adjustment in a chlorine dioxide stage.

In sulfite mills it is common to use the CEHD bleaching sequence, chlorine (C), alkali (E), hypochlorite (H), and chlorine dioxide (D). By varying the amount of alkali, usually sodium hydroxide, in the E-stage, one can extract more or less resin. Dispersing agents are often added, together with sodium hydroxide, in the E-stage, in order to keep the resin in dispersed form (and not agglomerated), so that as much as possible can be washed out in the washing step following the E-stage.

The final adjustment of the resin content usually is carried out in the D-stage, by varying the amount of chlorine dioxide added. The resin is separated from the pulp in the washing stage following the D-stage.

When resin problems occur in the mill (for instance foaming and clogging), it can be necessary to decrease the amount of chlorine in the C-stage, and correspondingly increase the amount of chlorine dioxide. As is well known in the art, chlorination of the resin makes it more difficult to handle. The great disadvantage of the use of considerable amounts of chlorine dioxide to deal with resin problems is the high price of this chemical.

In preparing pulp according to the alkaline kraft process, wood is not stored for a long time. In the preparation of, for instance, birch kraft pulp, it is important that the logs be debarked carefully, since the bark and, above all, the cambium-layer between the bark and the wood contain large amounts of resin. As in sulfite pulping, the resin dissolves in the alkali during the kraft pulping. In order to keep the resin in dispersed form during the digestion (so as to avoid clogging), tall oil is added to the digester. The resin extracted during the pulping is separated from the pulp in the subsequent washing step, and thus goes together with the black liquor to evaporation and then to combustion in the soda recovery boiler.

In the preparation of kraft pulp it is not possible to adjust the resin content by the addition of varying amounts of alkali in an alkali stage in the bleaching sequence. Rather, it is necessary to rely on the expensive bleaching chemical chlorine dioxide, for the final adjustment of the resin content.

In the preparation of birch kraft pulp, one is thus required to make expensive investments in high quality debarking equipment, and/or to add great amounts of the expensive chemical chlorine dioxide in the bleaching stage in order to overcome the resin problems. Even if these expensive steps are taken, it is difficult to reduce resin to the desired low resin content in the finished pulp. Pulps of low resin content are much in demand on the market.

In addition to what is stated above, it is possible to decrease the resin content of the cellulose pulp to a certain extent by the addition of selected surface-active agents, so-called wetting agents, at different stages of the pulping.

These methods are those which are most commonly used to overcome resin problems during pulping. However, other methods are described in the literature.

Swedish Pat. No. 150,651 states that in dealing with certain types of pulps that are especially difficult to deresinate, it may be suitable to treat the pulp mechanically in known manner in connection with the alkaline treatment. It is, however, not clearly stated what is meant by mechanical treatment. Neither is there any detailed description of how to proceed. Instead, it is proposed to carry out the alkaline treatment in the presence of a nonionic wetting agent, in order to reduce the resin content of the pulp.

In Finnish Pat. No. 28,621 there is described a method for the utilization of unbarked hardwood and saw mill rejects for the preparation of cellulose pulp. The method consists in a combined mechanical-chemical process for the treatment of the cellulose pulp after digestion, washing and screening. The unbleached pulp is treated mechanically at temperatures of between 10° and 60° C. in alkaline suspension in known beating or milling apparatus, after which the pulp is treated with alkaline and oxidizing chemicals at temperatures between 10° and 80° C., and then, finally, again is treated mechanically in the manner previously described.

In accordance with the example of the Finnish patent, the pulp is subjected to beating in a Hydrafiner or similar beating apparatus at a pH of about 8. This means that the mechanical beating or milling process is carried out at a low pulp consistency (not exceeding 6%), since the Hydrafiner and similar beating equipment can only work at low pulp concentrations.

It has, however, been shown that such treatment of the pulp is not successful in solving the deresination problem, because it does not markedly decrease the resin content of the pulp. One of the reasons for this seems to be that the mechanical treatment, i.e., the beating, is carried out at a relatively low pulp concentration. Because a low pulp concentration is used, the process consumes relatively large amounts of energy. Moreover, the beating or milling causes cutting of the fibers, which in many cases is undesirable.

Swedish Pat. No. 341,323 subjects the cellulose pulp to a mechanical treatment after the digestion, washing and, if desired, screening steps. The pulp before bleaching is subjected to a kneading and shearing action, with subsequent increase in temperature at a pulp concentration of from 10 to 50%, preferably from 25 to 35%, changing the structure of the fibers, with a possible increase in drainage resistance amounting to at most 4° SR. The so-treated pulp is diluted immediately to a pulp concentration of at most 6%, after which the pulp is bleached and dried to preferably a solids content of 90 to 95%. The objective of this process is to improve the paper-making properties of the pulp. Nowhere is the resin problem referred to in the specification, and in fact the process does not affect the resin problem in practice, as has been shown by tests which have been carried out and are discussed in more detail in the Examples In Lindahl, U.S. application Ser. No. 208,909, filed Nov. 21, 1980.

The invention of Ser. No. 208,909 provides a process for reduction of the resin content of bleached or unbleached cellulose pulps in their preparation from lignocellulosic materials which avoids these problems. In this process, lignocellulosic material is subjected to separation of the fibers, washing, screening, if desired, and delignifying bleaching, if desired. Deresination of the cellulose pulp to a desired low resin content is obtained by adjusting the pulp concentration to within the range from about 15 to about 35%, peferably from about 19 to about 29%; mixing the cellulose pulp with alkali in a sufficient amount to adjust the amount of alkali, calculated as NaOH, within the range from about 2 to about 17 g/kg of water accompanying the pulp; subjecting the pulp to a mild mechanical treatment in the bite of twin interdigitated rotating screws at an input energy of from 8 to 100 kWh per ton of pulp, preferably from 10 to 75 kWh per ton of pulp, and then removing and reacting the cellulose pulp at substantially the same pulp consistency with the added alkali for from about 0.1 to about 5 hours.

The invention of Ser. No. 208,909 also provides apparatus for reduction of the resin content of bleached or unbleached cellulose pulps comprising, in combination, means for adjusting the pulp concentration to within the range from about 15 to about 35%, preferably from about 19 to about 29%; mixing means for mixing the cellulose pulp with alkali in a sufficient amount, calculated as NaOH, within the range from about 2 to about 17 g/kg of water accompanying the pulp; means for subjecting the pulp to a mild mechanical treatment in the bite of twin interdigitated rotating screws at an input energy of from 8 to 100 kWh per ton of pulp, preferably from 10 to 75 kWh per ton of pulp; and means for reacting the cellulose pulp at substantially the same pulp consistency with the added alkali for from about 0.1 to about 5 hours.

In a preferred embodiment, the means for adjusting pulp concentration comprises a dewatering device provided with a supply conduit for addition of alkali to the pulp; the twin interdigitated rotating screws comprise a screw defibrator; a screw feeder is included provided with a supply conduit for alkali and a supply conduit for steam for transferring the pulp from the dewatering device to the screw defibrator; and the means for reacting the pulp with the added alkali comprises a reactor including a container for pulp; and means for transferring the pulp from the screw defibrator to the pulp container.

After the deresination, the cellulose pulp usually is bleached to its final brightness, which usually exceeds 90% ISO. It is also possible to terminate the manufacture at the deresination stage, resulting in unbleached or slightly bleached cellulose pulp.

The method has been successful in the manufacture of pulp with a resin content even when unstored or fresh wood is used as the starting material. Other pulp characteristics, such as the purity of the pulp, are also improved when using this method. However, the brightness of the unbleached or slightly bleached cellulose pulp is not in keeping with the low resin content of the deresinated pulp.

The present invention provides a process for reducing the resin content of bleached or unbleached cellulose pulps while improving their brightness. In this process, lignocellulosic material is subjected to separation of the fibers, washing, screening, if desired, and delignifying bleaching, if desired. Deresination of the cellulose pulp to a desired low resin content with an accompanying bleaching action is obtained by adjusting the pulp concentration to within the range from about 15 to about 35%, preferably from about 19 to 29%; mixing the cellulose pulp with alkali in a sufficient amount to adjust the amount of alkali, calculated as NaOH, within the range from about 0.5 to about 17 g/kg of water accompanying the pulp; adding sufficient oxidizing bleaching agent to the pulp to bring the amount of oxidizing bleaching agent to within the range from about 0.2 to about 22 g/kg of water; subjecting the pulp to a mild mechanical treatment in the bite of twin interdigitated rotating screws at an input energy of from 8 to 100 kWh per ton of pulp, preferably from 10 to 75 kWh per ton of pulp; and then removing and reacting the cellulose pulp at substantially the same pulp consistency with the added alkali and bleaching agent for from about 0.1 to about 5 hours.

The present invention also provides apparatus for reduction of the resin content of bleached or unbleached cellulose pulps comprising, in combination, means for adjusting the pulp concentration to within the range from about 15 to about 35%, preferably from about 19 to about 29%; mixing means for mixing the cellulose pulp with alkali in a sufficient amount, calculated as NaOH, within the range from about 0.5 to about 17 g/kg of water accompanying the pulp; and with sufficient oxidizing bleaching agent to bring the amount of oxidizing bleaching agent to within the range from about 0.2 to about 22 g/kg of water; means for subjecting the pulp to a mild mechanical treatment in the bite of twin interdigitated rotating screws at an input energy of from 8 to 100 kWh per ton of pulp, preferably from 10 to 75 kWh per ton of pulp; and means for reacting the cellulose pulp at substantially the same pulp consistency with the added alkali for from about 0.1 to about 5 hours.

In a preferred embodiment, the means for adjusting pulp concentration comprises a dewatering device provided with a supply conduit for addition of alkali to the pulp; the twin interdigitated rotating screws comprise a screw defibrator; a screw feeder is included provided with a supply conduit for alkali and a supply conduit for steam for transferring the pulp from the dewatering device to the screw defibrator; and the means for reacting the pulp with the added alkali comprises a reactor including a container for pulp; and means for transferring the pulp from the screw defibrator to the pulp container.

FIG. 1 shows a preferred embodiment of the apparatus suitable for use in the process of the invention, and this apparatus is utilized in the Examples as indicated.

The process of the invention is preferably carried out on washed unbleached cellulose pulp, after the lignocellulosic material has been digested to cellulose pulp, as in a digester with digesting chemicals recovered from spent digestion liquor, and then the pulping liquor washed out in a washing stage. The pulp concentration after washing usually is from 4 to 6%.

It is also desirable but not essential to screen the pulp prior to applying the process according to the invention. The pulp is diluted to a pulp concentration of from 0.5 to 3% during the screening.

In special cases, it may also be desirable to subject the pulp to a mild delignifying bleaching with a bleaching agent, for instance, chlorine and/or chlorine dioxide, before applying the process of the invention.

In the process of the invention, the pulp is dewatered in one or more stages to a relatively high pulp concentration within the range from about 15 to about 35%, preferably from about 19 to about 29%. Usually, the concentration of the pulp is carried out in one stage. Any conventional dewatering devices can be used, such as drum washers, belt washers, roll presses and screw presses. Whether the concentration of the pulp is carried out in one or more (for example, two) stages may depend to some extent on whether the process of the invention is applied in an already existing mill or whether the process is adopted in a new or rebuilt mill. In existing mills drum washers or thickeners in place after the screening stage raise the pulp concentration from the 0.5 to 3% in the screening stage to from 10 to 13%. However, the drum washer need not have such a high dewatering capacity. A very simple drum washer which raises the pulp concentration to 4% or more will suffice. After passage over the drum washer or thickener, the pulp is carried to a device in which the final dewatering to a pulp concentration of from 15 to 35% takes place. A preferred device is a screw press. To facilitate dewatering of the pulp, the pH of the incoming pulp may be adjusted to from 7 to 9 by the addition of alkali.

After the dewatering stage, alkali and oxidizing bleaching agent are added to the pulp.

Alkali is added to the pulp in an amount to bring the amount of alkali, calculated as NaOH, within the range from about 0.5 to about 17 g/kg of water accompanying the pulp. Sodium hydroxide is preferred as the alkali. It is, however, possible to add an equivalent weight of other alkaline compounds, such as potassium hydroxide, oxidized white liquor, green liquor, and sodium carbonate in admixture with sodium hydroxide.

Any oxidizing bleaching agent can be used. The preferred oxidizing bleaching agent is a peroxide bleaching agent, such as hydrogen peroxide, sodium peroxide, and peracetic acid; other peroxide bleaching agents such as performic acid, perpropionic acid, and barium peroxide can be used. Hydrogen peroxide is particularly suitable. Additional peroxide bleaching chemicals can be added, such as stabilizers and pH modifiers, for example, sulfuric acid, sodium hydroxide, sodium silicate, sodium phosphate, and magnesium sulfate.

Other types of oxidizing bleaching agents can be used, such as chlorine, chlorine dioxide and hypochlorite, oxygen and alkali and thioglycolic acid. The oxidizing bleaching agent is added to the pulp in an amount to bring the amount of bleaching agents to within the range from about 0.2 to about 22 g/kg, preferably from 0.3 to 11 g/kg water.

After this, the pulp is subjected to a mild mechanical treatment in a device suited for working high-consistency pulp, provided with twin interdigitated rotating screws, under such conditions that the energy input is from 8 to 100 kWh per ton of pulp, and preferably from 10 to 75 kWh per ton of pulp.

A suitable apparatus for such treatment is a screw defibrator (screw refiner), and especially suitable is the screw defibrator sold by MoDoMekan AB under the trademark FROTAPULPER ®. This screw defibrator has two rotating interdigitated screws which are arranged in parallel to each other in a housing provided with an inlet and an outlet for pulp. The screws are interdigitated or engage each other for kneading the pulp and at least some of the screw flights are provided with serrations or indentations on their outer periphery. Such a screw defibrator is described in U.S. Pat. Nos. 3,054,532, patented Sept. 18, 1962, 3,064,908, patented Nov. 20, 1962, 3,533,563, patented Oct. 13, 1970, and 3,724,660, patented Apr. 3, 1973.

Another type of screw defibrator that can be used is described in U.S. Pat. No. 4,284,247, patented Aug. 18, 1981, to Erik Folke Eriksson.

The pulp mixed with alkali, oxidizing bleaching agent, and any other chemicals is subjected to shearing and kneading forces in the screw defibrator in the form of pulsating pressure loads. As a result of this treatment, a very effective impregnation of the pulp with the added chemicals is obtained. As for the pulp fibers, the treatment is mild, since the fibers are not shortened (which is the case in beating or milling) or adversely affected in any other way.

The treatment in the screw defibrator usually is carried out at atmospheric pressure, but it can also be carried out at superatmospheric pressures of up to 500 kPa. During the mechanical treatment, the temperature of the pulp increases, due to liberation of heat, since at least 60% of the energy input is transformed to heat. The higher the input of energy, the greater is the temperature increase during the work.

After the mild mechanical treatment the pulp is transferred by means of a suitable device, such as a pump, screw feeder or belt conveyor, to a tower or similar container for continued reaction with the added chemicals (mainly alkali and oxidizing bleaching agent) at the desired temperature, within the range from about 20 to about 120° C., and preferably from about 50 to about 100° C. The retention time for the pulp in this stage can vary between six minutes and five hours.

After this, the pulp is washed, using any known washing apparatus, so that the resin extracted from the pulp and dissolved in the alkaline liquor is removed from the pulp. Thereafter, it is not necessary to subject the pulp for continued treatment, but it may be carried directly to drying or final treatment, for example, to manufacture of paper of different qualities. The method according to the invention is primarily applicable to the manufacture of unbleached or slightly bleached cellulose pulp. However, it is also possible to apply the method to the manufacture of pulp which is bleached to a varying extent, including bleaching to a final brightness exceeding 90% ISO. Usually, however, the pulp after it has been treated according to the invention is bleached in one or more bleaching stages in any selected bleaching sequence.

A good heat economy can be obtained by insulating the mechanical working unit, the transport equipment to the tower, and the tower itself. This heat may be utilized in a following bleaching stage, which means that the need of energy for heating the pulp to a temperature suitable for bleaching is reduced. In case the power input in the mechanical working stage is high, or when the mechanical treatment is carried out at superatmospheric pressure, it is feasible to discharge the pulp from this stage via a cyclone, for the separation of steam from the pulp. If the mechanical work is carried out at superatmospheric pressure, there is also the possibility to carry out the continued treatment under superatmospheric pressure, that is, to transport the pulp to the retention tower, and keep it there under superatmospheric pressure.

According to a preferred embodiment of the invention, a short retention time is interposed between the dewatering stage and the mild mechanical treatment. The short retention time suitably is established by transporting the pulp through a screw feeder. The retention time should be within the range from about 2 to about 10 seconds.

Besides using a screw feeder, it is also possible to pass the pulp through a chemical mixer, for mixing chemicals into the pulp.

It is advantageous to add at least part of the alkali to the pulp during the short retention time, for instance, in the screw feeder. More alkali is added after the pulp has been dewatered, that is, when the pulp leaves the screw press. It is, however, quite possible to add all the alkali at once, that is, either when the pump leaves the screw press, or in the screw feeder.

In certain cases it is advantageous to add other chemicals to the pulp besides alkali, such as surface-active agents (so-called wetting agents), and complex-forming substances. The addition of these chemicals is carried out in a way similar to the alkali addition.

In the treatment of certain pulps, it is necessary to raise the reaction temperature of the mild mechanical treatment of the pulp and the temperature of the subsequent reaction with alkali in the retention tower in excess of the temperature elevation which is caused by the kneading and shearing action in order to reach the resin removal intended. In such cases, steam is added to the pulp, and the addition of steam should be carried out during the short retention time.

The addition of chemicals and steam to the pulp lowers the pulp concentration. The concentration of pulp must not, however, be lower than 15% when the pulp is subjected to the mild mechanical treatment.

By subjecting the cellulose pulp to the treatment according to the invention and regulating the amount of alkali and oxidizing bleaching agent added, the temperature, and the input of energy, it is possible to adjust the resin content and brightness of the finished pulp to any desired level. An increase in the amount of alkali added, increased temperature, and increased input of energy, each alone, but especially in any combination, gives an increased dissolution of resin from the pulp, so that the resin content of the pulp is correspondingly reduced. An increase in the amount of oxidizing bleaching agent, increased temperature, and increased input of energy, alone or in any combination give an increased brightness of the pulp.

The process of the invention can be utilized in any pulping process, but especially in sulfite and kraft pulping.

In a sulfite mill, the present invention makes it possible to eliminate the storage of wood, so that fresh wood can be pulped directly in the mill. As a result, even if the cost of the equipment needed for the process of the invention is included, the costs for the preparation of sulfite pulp are considerably reduced. Even if the storage of wood at a sulfite mill is retained, the process of the invention is of great value, since one is able to adjust the resin content of the finished pulp in a totally different and better way than has been possible before. For an example, the need for chlorine-containing bleaching agents is considerably reduced, which is highly desirable to reduce environmental pollution.

In a kraft mill, the process of the invention makes it possible, for example, to prepare birch kraft pulp of an even and low resin content, which previously has not always been possible. Furthermore, one can in the preparation of such pulp lower the requirements for debarking of the birch wood, and decrease the addition of the expensive chemical chlorine dioxide, which also is advantageous in limiting environmental pollution.

The following Examples in the opinion of the inventors represent preferred embodiments of the invention.

EXAMPLE 1

A screened spruce sulfite pulp of paper pulp grade having the characteristics shown in Table I was treated according to the invention, using the apparatus shown in FIG. 1.

TABLE I

| | |
|---|---|
| Kappa number (SCAN-C 1:59) | 12.2 |
| R18, % (SCAN-C 2:61) | 78.2 |
| Viscosity, $dm^3/kg$ SCAN-C 15:62) | 1073 |
| Extract content DCM % (SCAN-C 7:62) | 1.93 |
| Brightness ISO, % (SCAN-C 11:62) | 69.2 |

The screened pulp at a temperature of 62° C. was passed through the conduit 1 of the apparatus shown in FIG. 1 to the screw press 2, in which the pulp was dewatered to a pulp concentration of 29.5%. The water that had been pressed out was drawn off through the conduit 3. Alkali in the form of aqueous sodium hydroxide (NaOH) from the reservoir 4 was fed to the pulp at the outlet of the screw press 2 through the conduits 5 and 6 in an amount of 1.0% NaOH by weight of the absolutely dry pulp. This addition gave a total alkali content of 4.2 g NaOH per kg water.

From the screw press 2 the pulp was passed through the conduit 7 to a screw feeder 8, and then to the screw difibrator 9, which was of the type that is sold by MoDoMekan AB under the trademark FROTAPULPER®. Just before the screw defibrator 9, aqueous hydrogen peroxide $H_2O_2$ from the reservoir 10 was fed to the pulp through the conduits 11 and 12 in an amount of 0.21% $H_2O_2$ by weight of the absolutely dry pulp, to give 0.9 g $H_2O_2$ per kg water.

In the screw defibrator 9 the pulp was subjected to a kneading and shearing action corresponding to an energy input of 28 kWh per ton of pulp. As a result, the temperature of the pulp rose to 69° C. After this, the pulp fell by gravity through the vertical shaft and conduit 13 to the tower 14. In the tower 14, the reactions between the pulp and the chemicals NaOH and $H_2O_2$ were brought to completion. After 120 minutes, a sample of the pulp was taken, washed, dried and analysed. The results of the analysis are shown in Table II.

As a Control, the above-described experiment was repeated except that no hydrogen peroxide was added to the pulp. This pulp was washed, dried and analysed, and the results are shown in Table II.

TABLE II

| Pulp Characteristics | Control 1 | Example 1 |
|---|---|---|
| Kappa number | 9.7 | 8.0 |
| R18, % | 78.3 | 78.3 |
| Viscosity, $dm^3/kg$ | 1070 | 1066 |
| Extract content DCM, % | 0.27 | 0.24 |
| Brightness ISO, % | 66.0 | 73.9 |

As is evident from the data, a higher brightness was obtained by the method according to the invention, compared to the Control. Furthermore, the Kappa number of the pulp was decreased more, compared to the Control while maintaining the same viscosity. The resin content is very low for both pulps.

Two further comparisons were made, as Controls 2 and 3, but on a laboratory scale.

In Control 2, only NaOH was added, and in Control 3 only NaOH+$H_2O_2$ was added to the pulp in a conventional way. In Control 2, a certain amount of pulp passed to a treating vessel, which was kept in a water bath at 69° C. Aqueous 1% NaOH by weight of the absolutely dry pulp was mixed into the pulp by means of a propeller stirrer. The pulp concentration was 12%. This addition gave a total amount of NaOH of 1.4 gram per kg water. During 120 minutes the pulp was permitted to react with the sodium hydroxide after which the pulp was washed, dried and analysed.

In Control 3, the same thing was done, with the only difference, that also hydrogen peroxide $H_2O_2$ was added together with NaOH. The aqueous hydrogen peroxide was added in an amount of 0.21% by weight of the absolutely dry pulp, giving a total amount of $H_2O_2$ of 0.3 g per kg water present. The pulp was finished off by washing, drying and analysing. The data from the analysis in comparison with the pulp according to the invention of Example 1 are shown in Table III.

TABLE III

| Pulp Characteristics | Control 2 NaOH | Control 3 NaOH + $H_2O_2$ | Example 1 |
|---|---|---|---|
| Kappa number | 10.4 | 9.7 | 8.0 |
| R18, % | 78.2 | 78.3 | 78.3 |
| Viscosity, $dm^3/kg$ | 1066 | 1069 | 1066 |
| Extract content DCM, % | 0.69 | 0.68 | 0.24 |
| Brightness ISO, % | 65.7 | 72.1 | 73.9 |

As is evident from the Table, the pulp manufactured according to the invention is far superior to the Control pulps in Kappa number, extract content and brightness. Especially noteworthy is the difference in extract content. Although in Control 3 both NaOH+$H_2O_2$, have been added to the pulp in the same amount as in Example 1 the method according to the invention gives a better pulp, not only in resin content but also in the Kappa number and brightness.

These data show that it is not only the added chemicals themselves but also the mode of addition that are responsible for the good qualities of the pulp treated according to the invention.

EXAMPLES 2 TO 4

A screened birch sulfate pulp having the characteristics shown in Table IV was treated by the process according to the invention.

TABLE IV

| | |
|---|---|
| Kappa number | 18.7 |
| Viscosity, $dm^3/kg$ | 1182 |
| Extract content DCM, % | 0.88 |
| Brightness ISO, % | 31.7 |

As a pretreatment, the screened pulp was subjected to a delignifying bleaching by chlorine and chlorine dioxide. Chlorine and chlorine dioxide were added to the pulp at the same time in amounts corresponding to 3.4% and 0.3% respectively, calculated as active chlorine by weight of the absolutely dry pulp. The treatment temperature was 40° C., and the time 30 minutes. Thereafter, the pulp was washed.

This partially delignified pulp then was subjected to the process according to the invention, using the apparatus shown in FIG. 1.

The pulp at a temperature of 58° C. was passed through the conduit 1 to the screw press 2, in which the pulp was dewatered to a pulp concentration of 27.8%. The water that had been pressed out was drawn off through the conduit 3. Aqueous NaOH from the reservoir 4 was fed to the pulp at the outlet of the screw press through the conduits 5 and 6 in an amount of 1.85% NaOH by weight of the absolutely dry pulp to a total amount of 7.1 g NaOH per kg water. From the screw press 2 the pulp was passed through the conduit 7 to the screw feeder 8, and thence to the screw defibrator 9, which was of the type that is sold by MoDoMekan AB under the trademark FROTAPULPER ®. Just before the screw defibrator 9 aqueous hydrogen peroxide $H_2O_2$ from the reservoir 10 was fed to the pulp through the conduits 11 and 12 in an amount of 0.33% $H_2O_2$ by weight of the absolutely dry pulp, to corresponding to 1.3 g $H_2O_2$ per kg water.

In the screw defibrator 9 the pulp was subjected to a kneading and shearing action corresponding to an input of energy of 38 kWh per ton of pulp. As a result, the temperature of the pulp rose to 67° C. After this pulp fell by gravity through the vertical shaft and the conduit 13 to the tower 14. In the tower 14, the reactions between the pulp and the chemicals NaOH and $H_2O_2$ were brought to completion. Samples of the pulp were taken after retention times of 10 minutes (Example 2), 30 minutes (Example 3), and 120 minutes (Example 4) in the tower 14. These samples were washed, dried and analysed. The data are shown in Table V.

As a control, a portion of the partially delignified pulp was subjected to treatment with both NaOH and $H_2O_2$ in a conventional way. A certain amount of pulp was passed into a treating vessel, which was kept in a water bath at 67° C. 1.85% NaOH and 0.33% $H_2O_2$ by weight of the absolutely dry pulp were mixed into the pulp by a propeller stirrer. The pulp concentration was 12%. These additions corresponded to 2.5 g NaOH per kg water, and 0.5 g $H_2O_2$ per kg water. The pulp and the chemicals were then allowed to react with each other for 120 minutes, after which samples of the pulp were washed, dried and analysed. The data from the analysis are given in Table V.

TABLE V

| Pulp Characteristics | Control | Example 2 | Example 3 | Example 4 |
|---|---|---|---|---|
| Kappa number | 3.8 | 3.1 | 2.9 | 2.9 |
| Viscosity, $dm^3/kg$ | 1107 | 1110 | 1103 | 1106 |
| Extract content DCM, % | 0.68 | 0.26 | 0.24 | 0.23 |
| Brightness ISO, % 57.2 | 58.0 | 58.8 | 60.1 | |

The above stated data show that even at a short retention time after the mild mechanical treatment, the method according to the invention gives a lower Kappa number, higher brightness and a considerably lower resin content compared to the Control. It is also clear that an increased retention time in the final stage according to the invention is favorable, especially for the brightness of the pulp.

EXAMPLE 5

A partially screened (in the partial screening, knots and larger nondigested pieces of wood were separated from the pulp, but material normally classified as shives was not separated) sulfate pulp manufactured from mixed softwood composed mainly of eucalyptus saligna and eucalyptus grandis and having the characteristics shown in Table VI below was treated by the process according to the invention of Example 1 in comparison with a control.

TABLE VI

| | |
|---|---|
| Kappa number | 22.2 |
| Viscosity, $dm^3/kg$ | 1170 |
| Extract content DCM, % | 0.91 |
| Brightness ISO, % | 34.9 |

This pulp was treated according to the invention in the apparatus of FIG. 1.

The pulp at a temperature of 55° C. was passed through the conduit 1 to the screw press 2, in which the pulp was dewatered to a pulp concentration of 31.0%. The water that had been pressed out was drawn off through the conduit 3. Aqueous NaOH solution from the reservoir 4 was fed to the pulp at the outlet of the screw press 2 through the conduits 5 and 6 in an amount of 0.95% NaOH by weight of the absolutely dry pulp, giving a total of 4.3 g NaOH per kg water.

From the screw press 2 the pulp was passed through the conduit 7 to the screw feeder 8, and thence to the screw defibrator 9, which was of the type that is sold by MoDoMekan AB under the trademark FROTAPULPER ®. Just before the screw defibrator 9, aqueous sodium hypochlorite from the reservoir 10 was fed to the pulp through the conduits 11 and 12 in an amount of 0.55% calculated as active chlorine by weight of the absolutely dry pulp, giving 2.5 g NaClO per kg water. In the screw defibrator 9 the pulp was subjected to a kneading and shearing action corresponding to an input of energy of 26 kWh per ton of pulp. As a result the temperature of the pulp rose to 63° C.

After this the pulp fell by gravity through the vertical shaft and the conduit 13 to the tower 14. In the tower 14 the reactions between the pulp and the chemicals NaOH and NaClO were brought to completion. After a retention time of 120 minutes, samples of the pulp were taken, washed, dried and analysed. The results of the analysis are given in Table VII.

As a control, another portion of the partially screened pulp was subjected to treatment with both NaOH and NaClO in a conventional way. A certain amount of pulp was passed into a treating vessel, which was kept in a water bath at 63° C. 0.95% NaOH by weight of the absolutely dry pulp, and 0.55% NaClO calculated as active chlorine by weight of the absolutely dry pulp, were mixed into the pulp using a propeller stirrer. The pulp concentration was 12%. These additions of chemicals corresponded to 1.3 g NaOH per kg water and 0.8 g NaClO kg water present. The pulp and the chemicals were then allowed to react with each other for 120 minutes, after which a sample of the pulp was washed, dried and analysed. The results of analysis are given in Table VII.

TABLE VII

| Pulp Characteristics | Control | Example 5 |
|---|---|---|
| Kappa number | 14.6 | 13.2 |
| Viscosity, $dm^3/kg$ | 1091 | 1095 |
| Extract content DCM, % | 0.57 | 0.21 |
| Brightness ISO, % | 43.9 | 45.7 |

The data show that the method according to the invention gives a pulp with a lower Kappa number, higher brightness and considerably lower resin content than the Control pulp treated according to the conventional method, even when the oxidative bleaching agent consists of sodium hypochlorite.

The two pulps obtained in the described way were also analysed in order to determine their content of impurities. Samples of the pulps were screened on a Sommerville screen with a slot size of 0.15 mm, and the amount of material retained on the screen plate was measured. The Control and the untreated, i.e. the partially screened pulp, were also analyzed. The results are given in Table VIII.

TABLE VIII

| | Original Pulp | Control | Example 5 |
|---|---|---|---|
| Shives content % by weight of absolutely dry pulp | 0.72 | 0.61 | 0.24 |

The data show that the method according to the invention is particularly effective in elimination of shives from the pulp.

EXAMPLE 6

A screened spruce stone groundwood pulp having the pulp characteristics shown in Table IX was deresinated by the process according to the invention using the apparatus of FIG. 1 in comparison with a Control deresinated in a conventional way.

In order to remove heavy metals, first the pulp was treated with 0.2% by weight of the absolutely dry pulp aqueous diethylenediaminepentaacetic acid at 65° C. for 2 hours.

The pulp at a temperature of 50° C. was passed through the conduit 1 to the screw press 2, in which the pulp was dewatered to a pulp concentration of 31% . The water that had been pressed out was drawn off through the conduit 3. At the outlet of the screw press 2, an aqueous solution of NaOH and sodium silicate stored in the reservoir 4 in an amount of 1.8% NaOH and 4.0% $Na_2SiO_3$, by weight of the absolutely dry pulp was fed to the screw press 2 through the conduits 5 and 6. This addition corresponds to 8.1 g NaOH and 18 g $Na_2SiO_3$ per kg water present. From the screw press 2 thence to the screw defibrator 9, which was of the type that is sold by MoDoMekan AB under the tradename FROTAPULPER ®.

Just before the screw defibrator 9 aqueous hydrogen peroxide in the reservoir 10 was fed to the pulp through the conduits 11 and 12 in an amount of 3% by weight of the absolutely dry pulp. This addition corresponded to 13.5 g $H_2O_2$ per kg water present.

In the screw defibrator 9 the pulp was subjected to kneading and shearing action corresponding to an input of energy of 35 kWh per ton of pulp. As a result the temperature of the pulp rose to 58° C. After this the pulp fell by gravity through the vertical shaft and the conduit 13 to the tower 14. In the tower 14, the reactions between the pulp and the chemicals NaOH, $Na_2SiO_3$ and $H_2O_2$ were brought to completion. After a retention time of 120 minutes, samples of the pulp were taken, washed, dried and analysed. The data from the analysis are given from Table IX.

As a control, another portion of the screened and pretreated spruce pulp was subjected to treatment with NaOH, $Na_2SiO_3$ and $H_2O_2$ in a conventional way. The pulp was passed into a treating vessel, which was kept in a water bath at a temperature of 60° C. 1.8% NaOH, 4.0% $Na_2SiO_3$ and 3% $H_2O_2$ by weight of the absolutely dry pulp corresponding to 2.5 g NaOH, 5.5 g $Na_2SiO_3$ and 4.1 g $H_2O_2$ per kg water were mixed into the pulp using a propeller stirrer. The pulp concentration was at that moment 12%. The pulp and the chemicals were then allowed to react for 120 minutes, after which samples of the pulp were washed, dried, and analysed for brightness and extract content (resin). The results of the analysis are given in Table IX.

Besides brightness and extract content the different pulps (including the original pulp) were analyzed for impurities content. Samples of the pulps were screened on a Sommerville screen with a slot size of 0.15 mm and the amount of material retained on the screen was measured. The data appear in Table IX below.

TABLE IX

| Pulp Characteristics | Original pulp | Control | Example 6 |
|---|---|---|---|
| Brightness ISO, % | 65.8 | 76.9 | 79.5 |
| Extract content DKM, % | 1.18 | 0.71 | 0.25 |
| Content of shives, % | 0.16 | 0.11 | 0.06 |

The data show that the method according to the invention gives a pulp with a higher brightness and essentially lower extract content, compared to the Control pulp treated in a conventional way. It is also evident that the method according to the invention is very effective in elimination of particles.

In the above described Examples, alkali in the form of sodium hydroxide is added to the pulp at the outlet of the screw press 2 via the conduits 5 and 6 in FIG. 1. The oxidative bleaching agent is added just before the screw difibrator via the conduits 11 and 12.

However, it is possible and advantageous to add alkali as well as an oxidative bleaching agent in other locations, in the method according to the invention.

For example, alkali can be added to the pulp in the screw feeder 8 via the conduit 5. Furthermore, alkali can be added to the pulp in the screw defibrator 9 via the conduit 15. It is also possible to separate the addition of alkali into many increments at the same or several locations.

The oxidative bleaching agent can be added to the pulp in the screw defibrator 9 via the main conduit 11. It is also possible to add the oxidative bleaching agent to the pulp in the screw press 2 via the conduits 11 and 16, and in the screw feeder 8 via the conduits 11, 16 and 17. Corresponding to the addition of alkali, the oxidative bleaching agent can be separated into many increments, added at the same or several locations.

If necessary to increase the temperature considerably, steam can be added to the pulp in the screw feeder 8 via the conduit 18.

The process of the invention is applicable to cellulose pulps prepared from any kind of wood. In general, hardwood pulps such as beech and oak are more costly than softwood pulps such as spruce and pine pulp, but pulps from both types of wood can be deresinated satisfactorily using this process. Exemplary hardwood pulps include birch, beech, poplar, cherry, sycamore, hickory, ash, oak, chestnut, aspen, maple, alder and eucalyptus pulps. Exemplary softwood pulps include spruce, fir, pine, cedar, juniper and hemlock pulps.

The process of the invention is particularly suited for use with pulps prepared from wood by digestion by means of chemical processes, such as sulphite, sulphate, oxygen gas/alkali, bisulphite, and soda cooking processes. The method can also be applied to pulps obtained by semichemical, mechanical and thermomechanical processes.

As complexing agents any known chelating inorganic and organic acids and salts can be used, including:

(1) Aliphatic alpha-hydroxycarboxylic acids of the type RCHOHCOOH and the corresponding beta-hydroxycarboxylic acids $RCHOHCH_2COOH$.

Exemplary alpha- and beta-hydroxy carboxylic acids are glycolic acid, lactic acid, glyceric acid, α, β-dihydroxybutyric acid, α-hydroxybutyric acid, α-hydroxyisobutyric acid, α-hydroxy n-valeric acid, α-hydroxyisovaleric acid, β-hydroxyisobutyric acid, β-hydroxyisovaleric acid, erythronic acid, threonic acid, trihydroxyisobutyric acid, and sugar acids and aldonic acids, such as gluconic acid, galactonic acid, talonic acid, mannoic acid, arabonic acid, ribonic acid, xylonic acid, lyxonic acid, gulonic acid, idonic acid, altronic acid, allonic acid, ethenyl glycolic acid, and β-hydroxyisocrotonic acid.

(2) Organic acids having two or more carboxylic groups, and no or from one to ten hydroxyl groups.

Exemplary are oxalic acid, malonic acid, tartaric acid, malic acid, and citric acid, ethyl malonic acid, succinic acid, isosuccinic acid, glutaric acid, adipic acid, suberic acid, azelaic acid, maleic acid, furamic acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

(3) Nitrogen-containing polycarboxylic acids and alkali metal salts.

Several important acids belonging to this group have the formula:

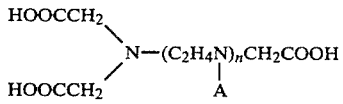

or alkali metal salts thereof, in which A is the group $—CH_2COOH$ or $—CH_2CH_2OH$, where n is an integer from zero to five. The mono, di, tri, tetra, penta and higher alkali metal salts are useful, according to the available carboxylic acid groups converted to alkali metal salt form.

Examples of such compounds are ethylene diamine tetraacetic acid, ethylene diamine triacetic acid, nitrilotriacetic acid, diethylenetriaminopentaacetic acid, tetraethylenepentamine heptaacetic acid, and hydroxyethylene diamine triacetic acid, and their alkali metal salts, including the mono, di, tri, tetra and penta sodium, potassium and lithium salts thereof. Other types of aminocarboxylic acids which can be used to advantage are iminodiacetic acid, 2-hydroxyethyliminodiacetic acid, cyclohexanediamine tetraacetic acid, anthranil-N,N-diacetic acid, and 2-picolylamine-N,N-diacetic acid.

(4) The polyphosphoric acids and alkali metal salts.

Exemplary are disodium manganous pyrophosphate, trisodium manganous tripolyphosphate and sodium manganous polymetaphosphate.

The surface-active or wetting agent can be of the anionic type, of the nonionic type, or the mixed nonionic-anionic type. Mixtures of anionic and nonionic surfactants can also be employed. Among the anionic surfactants which can be employed are the alkyl aryl sulfonates, the alkyl sulfonates, the alpha-olefin sulfonates, the alkyl ether polyglycol sulfates, and the alkyl phenol ether sulfates. These are all known compounds.

Exemplary of the alkyl aryl sulfonates are the alkyl benzene sulfonates, which have the general formula:

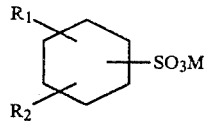

$R_1$ is a straight or branched chain alkyl radical having from about four to eighteen carbon atoms. $R_2$ is hydrogen or a straight or branched chain alkyl radical having from one to about twelve carbon atoms. The total of the number of carbon atoms in $R_1$ and $R_2$ is within the range from about ten, and to about twenty-four. M is hydrogen, or an alkali metal, ammonium or organic amine cation.

Examples of suitable alkyl benzene sulfonates are sodium dodecylbenzene sulfonate, sodium polypropylene benzene sulfonate (Lewis U.S. Pat. No. 2,477,383), sodium tridecylbenzene sulfonate, sodium cetylbenzene sulfonate, potassium dodecyl toluene sulfonate, triethanolamine dodecylbenzene sulfonate, potassium dinonylbenzene sulfonate, sodium didodecylbenzene sulfonate, and ammonium polypropylene benzene sulfonate.

The alkyl sulfonates have the general formula:

$$R_3—SO_3M$$

$R_3$ is a straight or branched chain alkyl group having from about ten to about twenty carbon atoms, and M is hydrogen, or an alkali metal, ammonium or organic amine cation. Such sulfonates are obtained by sulfonating paraffinic hydrocarbons with a mixture of sulfur dioxide and oxygen using energy rich radiation. Exemplary are sodium cetyl sulfonate, potassium stearyl sulfonate, and triethanolamine myristyl sulfonate.

The alpha-olefin sulfonates have the formula:

$$R_4—SO_3M$$

$R_4$ is an alkylene (ethylenically unsaturated) radical having from about ten to about twenty carbon atoms, and M is hydrogen, or an alkali metal, ammonium or organic amine cation. Such sulfonates are obtained by sulfonation of alpha-olefins of the general formula:

$$R_5—CH=CH_2$$

$R_5$ is an alkyl radical having from about nine to about nineteen carbon atoms. Exemplary is the sodium salt of the alpha-olefin sulfonic acid obtained by the sulfonation of a mixture of alpha-olefins having from fourteen to eighteen carbon atoms.

Also useful are the alkyl sulfates, which have the formula:

$$R_6OSO_3M$$

$R_6$ is an alkyl radical having from about ten to about twenty-two carbon atoms, and M is hydrogen, an alkali metal, ammonium, or an organic amine cation. Exemplary are sodium coconut oil fatty alcohols sulfate, potassium cetyl alcohol sulfate, ammonium stearyl alcohol sulfate, and triethanolamine lauryl alcohol sulfate.

The alkyloxyalkylene sulfates have the general formula:

$$R_7O(CH_2-\underset{\displaystyle R_8}{\underset{|}{CH}}-O)_nSO_3M$$

$R_7$ is an alkyl radical having from about twelve to about twenty carbon atoms. $R_8$ is hydrogen or methyl. M is hydrogen, or an alkali metal, ammonium or organic amine cation. n is an integer representing the average number of the oxyalkylene units indicated, and is within the range from 2 to 6. It will be understood that n can represent an average number, such as 2.5. Exemplary are the sodium salt of sulfonated lauryl alcohol condensed with 3 moles of ethylene oxide, and the potassium salt of sulfonated cetyl stearyl alcohol condensed with 2 moles of propylene oxide, and then 2 moles of ethylene oxide.

These and the alkyl phenol oxyalkylene sulfates below are examples of mixed nonionic:anionic surfactants.

The alkyl phenol oxyalkylene sulfates have the general formula:

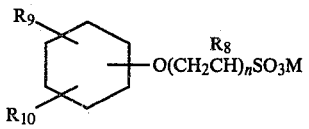

$R_8$ is as above. $R_9$ is a straight or branched alkyl radical having from four to about sixteen carbon atoms, and $R_{10}$ is hydrogen or a straight or branched alkyl radical having from one to about fourteen carbon atoms, the total number of carabon atoms in $R_9$ and $R_{10}$ being within the range from eight to twenty-four. n represents the number of units enclosed by the brackets, and is a number from 1 to 6. It will be understood that n can be an average value, such as 3.5. Exemplary are sodium nonyl phenol oxyethylene sulfate (condensed with 4 moles of ethylene oxide), potassium dinonyl phenol oxyethylene sulfate (condensed with 6 moles of ethylene oxide), ammonium dibutyl phenol oxyethylene sulfate (condensed with 3 moles of ethylene oxide), and triethanolamine dodecylcresol oxyethylene sulfate (condensed with 4 moles of ethylene oxide).

The nonionic surfactants which can be employed include the polyoxyalkylene glycol monothers, monoamines, monoamides, monocarboxylic acid esters and monothiocarboxylic acid esters.

The alkyl oxyalkylene ether and ester and thioether and ester derivatives have the following general formula:

$$R-A(CH_2\underset{\displaystyle R_8}{\underset{|}{CH}}O)_n-CH_2\underset{\displaystyle R_8}{\underset{|}{CH}}OH$$

$R_8$ is as above, and R is a straight or branched chain saturated or unsaturated hydrocarbon group having from about five to about eighteen carbon atoms, or an aralkyl group having an aryl nucleus to which is attached a straight or branched chain saturated or unsaturated hydrocarbon group having from about eight to about eighteen carbon atoms, linked through A to the aryl nucleus.

A is ether oxygen, thioether, amino, amido, a carboxylic acid ester or a thiocarboxylic acid ester group. n is a number from 8 to 35, and can represent an average number, such as 10.5.

Exemplary R radicals include amyl, octyl, nonyl, decyl, tetradecyl, lauryl, myristyl, cetyl, or stearyl. Exemplary aralkyl groups include octylphenyl, nonylphenyl, decylphenyl, and stearylphenyl. These compounds are prepared by condensation of the corresponding alcohol, mercaptan, amine, oxy or thio fatty acids or esters with ethylene oxide. Exemplary are the condensation products of oleyl or lauryl alcohol, mercaptan or amine, or oleic or lauric acid, with from 8 to 17 moles of ethylene oxide, and the polyoxyethylene ester of tall oil fatty acids.

In the case where R is aralkyl, the polyoxyalkylene surfactants have the formula:

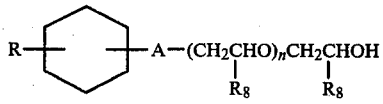

$R_8$ is as above. R is a straight or branched chain saturated or unsaturated hydrocarbon group having at least five carbon atoms up to about eighteen carbon atoms.

A is oxygen or sulfur, and n is a number within the range from 8 to 35.

R may, for example, be a straight or branched chain amyl, octyl, nonyl, dodecyl, tetradecyl, lauryl, cetyl, myristyl or stearyl group. Exemplary are condensation products of octyl and nonyl phenol and thiophenol with from 8 to 17 moles of ethylene oxide.

Also useful are the mixed polyoxyethylene oxypropylene ethers having the formula:

$$Y_n[CH_2H_4O)_x(C_3H_6O)_m(C_2H_4O)_y]_pH_n$$

These compounds are described in U.S. Pat. Nos. 2,674,619 to Lundsted, dated Apr. 6, 1954, and 2,677,700 to Jackson et al., dated May 6, 1954. They are condensates of a 1,2-alkylene oxide, such as 1,2-propylene oxide and 1,2-ethylene oxide, the ethylene oxide residues constituting from 20 to 90% of the resulting concentrate. Y as defined in these patents is the residue of an organic compound containing therein a single hydrogen atom capable of reacting with a 1,2-alkylene oxide, and the total of x and y is from 2 to 20. x and y may also be zero. n is a number from 1 to 25; p is a number from 1 to 5, and the average weight of the entire block polymer is from 1000 to 4000.

Organic compounds suitable for forming Y are compounds in which the hydrogen atoms are activated by an oxygen atom, such as in a hydroxyl group, a phenol group or a carboxyl group, or by a basic nitrogen atom, such as in an amine group and amide group, a sulfamide group, a carbamide group, and a thiocarbamide group, or by a sulfur atom, such as in a mercaptan.

Exemplary Y compounds are glycerol, ethylene glycol, propylene glycol, methanol, ethanol, isopropanol, n-butanol, 2-ethylhexanol, lauryl alcohol, cetyl alcohol, stearyl alcohol, eicosanol, oleyl alcohol, so-called OX-O-alcohol mixtures, butanediol, pentaerythritol, oxalic acid, triethanolamine, aniline, resorcinol, triisopropanolamine, sucrose, ethylenediamine, diethylenetriamine, acetamide, coconut oil fatty amine, methyl mercaptan, dodecyl mercaptan, hexadecyl mercaptan, etc.

Exemplary of this type of nonionic surfactants are propylene glycol condensed with 20 moles of propylene oxide and then with 5 moles of ethylene oxide, Y being hydroxyl, n=1, x+y=5, m=21, and p=1, as well as ethylene diamine with which have been condensed 12 moles of propylene oxide followed by 10 moles of ethylene oxide. Y being an ethylenediamine residue, n=4, x=0, y=2.5, m=3, and p=4.

Another type of polyoxyalkylene glycol ether surfactants has the formula:

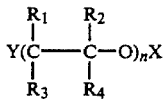

Y is an organic residue as defined above, and $R_1$, $R_2$, $R_3$ and $R_4$ are selected from the group consisting of hydrogen, aliphatic and aromatic radicals, at least one of these substituents not being hydrogen. n is a number greater than 6.4, as determined by hydroxyl number, and X is a water-solubilizing group, as defined in U.S. Pat. Nos. 2,674,691 and 2,677,700.

Exemplary of this type of compound are the fatty alcohol styrene oxide condensates containing 7 moles of styrene oxide, with the water-solubilizing group X being 70 moles of ethylene oxide.

Having regard to the foregoing disclosure the following is claimed as the inventive and patentable embodiments thereof:

1. A process for reducing the resin content of bleached and unbleached cellulose pulps while improving their brightness, which comprises adjusting the pulp concentration to within the range from about 15 to about 35%; mixing the cellulose pulp with alkali in a sufficient amount to adjust the amount of alkali, calculated as NaOH, within the range from about 0.5 to about 17 g/kg of water; adding sufficient oxidizing bleaching agent to the pulp to bring the amount of oxidizing bleaching agent to within the range from about 0.2 to about 22 g/kg of water; subjecting the pulp to a mild mechanical treatment in the bite of twin interdigitated rotating screws at an input energy of from 8 to 100 kWh per ton of pulp; and then removing and reacting the cellulose pulp at substantially the same pulp consistency with the added alkali and bleaching agent for from about 0.1 to about 5 hours.

2. A process according to claim 1 in which the oxidizing bleaching agent is added in an amount of from 0.3 to 11 g/kg water.

3. A process according to claim 1 in which the oxidizing bleaching agent is a peroxide bleaching agent.

4. A process according to claim 1 in which the oxidizing bleaching agent is a hypochlorite bleaching agent.

5. A process according to claim 1 in which the alkali is sodium hydroxide.

6. A process according to claim 1 in which the pulp consistency is adjusted to within the range from about 19 to about 29%.

7. A process according to claim 1 in which the input energy is from 10 to 75 kWh per ton of pulp.

8. A process according to claim 1 in which the cellulose pulp is bleached.

9. A process according to claim 1 in which the cellulose pulp is unbleached.

10. A process according to claim 1 in which the cellulose pulp is held for a short time after adjusting pulp concentration and before the mild mechanical working; and the alkali and oxidizing bleaching agent are added during the adjustment of the pulp concentration and during the holding time.

11. A process according to claim 10 in which steam is added during the holding time.

12. A process according to claim 10 in which during the short holding time the cellulose pulp is transported to the mild mechanical working.

13. A process according to claim 10 in which the holding time is from two to ten seconds.

14. A process according to claim 1 in which in addition to alkali and bleaching agent at least one member selected from the group consisting of surface-active agents and complex-forming agents is added.

15. A process according to claim 1 in which the pulp is reacted with oxygen gas during the reaction with alkali.

16. A process according to claim 1 in which the cellulose pulp is unbleached chemical cellulose pulp from which spent pulp liquor has been washed out in a washing stage at a washed pulp concentration of from 4 to 6%.

17. A process according to claim 1 in which cellulose pulp is screened cellulose pulp diluted to a pulp concentration of from 0.5 to 3% during the screening.

18. A process according to claim 1 in which the pulp is bleached in a mild delignifying bleaching with a bleaching agent selected from the group consisting of chlorine and chlorine dioxide before or after applying the process.

19. A process according to claim 1, in which the pulp is bleached with a peroxide bleaching agent selected from the group consisting of hydrogen peroxide, sodium peroxide and peracetic acid before or after applying the process.

20. A process according to claim 1 in which the alkali added is selected from the group consisting of sodium hydroxide, potassium hydroxide, oxidized white liquor, green liquor, and sodium carbonate in admixture with sodium hydroxide.

* * * * *